US007665432B2

(12) United States Patent
Vanderpoel

(10) Patent No.: US 7,665,432 B2
(45) Date of Patent: Feb. 23, 2010

(54) VALVE ACTUATION SYSTEM AND METHOD OF DRIVING TWO SLAVE PISTONS WITH ONE MASTER PISTON

(75) Inventor: Richard E. Vanderpoel, Bloomfield, CT (US)

(73) Assignee: Jacobs Vehicle Systems, Inc., Bloomfield, CT (US)

( * ) Notice: Subject to any disclaimer, the term of this patent is extended or adjusted under 35 U.S.C. 154(b) by 88 days.

(21) Appl. No.: 11/637,047

(22) Filed: Dec. 12, 2006

(65) Prior Publication Data

US 2008/0135796 A1 Jun. 12, 2008

(51) Int. Cl.
*F01L 1/34* (2006.01)

(52) U.S. Cl. ..... 123/90.12; 91/392

(58) Field of Classification Search ..... 123/90.12, 123/90.13; 91/392; 137/493, 625
See application file for complete search history.

(56) References Cited

U.S. PATENT DOCUMENTS 5,746,175 A * 5/1998 Hu ..... 123/322
5,852,997 A * 12/1998 Vanderpoel ..... 123/446
6,112,710 A * 9/2000 Egan et al. ..... 123/90.12
6,321,701 B1 * 11/2001 Vorih et al. ..... 123/90.12
6,920,868 B2 * 7/2005 Ruggiero et al. ..... 123/568.14

* cited by examiner

*Primary Examiner*—Ching Chang
(74) *Attorney, Agent, or Firm*—Kelley Drye & Warren, LLP

(57) ABSTRACT

Apparatus and methods for hydraulic valve actuation of engine valves are disclosed. An exemplary embodiment of the present invention may include a plurality of slave piston assemblies that impart motion to the engine valves, wherein the motion is operable to open and close the engine valves. A dual diameter master piston assembly may be used to drive the plurality of slave pistons. The dual diameter master piston assembly may be divided into two or more elements with, for example, a spring bias or a button and T-slot assembly to hold the two elements together.

17 Claims, 2 Drawing Sheets

VALVE ACTUATION SYSTEM AND METHOD OF DRIVING TWO SLAVE PISTONS WITH ONE MASTER PISTON

FIELD OF THE INVENTION

Apparatus and methods consistent with present invention relate to a hydraulic valve actuation system for internal combustion engine valves.

BACKGROUND OF THE INVENTION

Valve actuation in an internal combustion engine is required in order for the engine to produce positive power. During positive power, one or more intake valves may be opened to admit fuel and air into a cylinder for combustion. One or more exhaust valves may be opened to allow combustion gas to escape from the cylinder. Intake, exhaust, and/or auxiliary valves also may be opened during positive power at various times to recirculate gases for improved emissions.

Engine valve actuation also may be used to produce engine braking and exhaust gas recirculation (EGR) when the engine is not being used to produce positive power. During engine braking, the exhaust valves may be selectively opened to convert, at least temporarily, the engine into an air compressor. In doing so, the engine may develop retarding horsepower to help slow the vehicle down. This can provide the operator with increased control over the vehicle and substantially reduce wear on the service brakes of the vehicle.

In many internal combustion engines, the intake and exhaust valves may be opened and closed by fixed profile cams, and more specifically by one or more fixed lobes that are an integral part of each of the cams. Benefits such as increased performance, improved fuel economy, lower emissions, and better vehicle driveablity may be obtained if the intake and exhaust valve timing and lift can be varied. The use of fixed profile cams, however, can make it difficult to adjust the timings and/or amounts of engine valve lift in order to optimize them for various engine operating conditions, such as different engine speeds.

One proposed method of adjusting valve timing and lift, given a fixed cam profile, has been to provide a "lost motion" device in the valve train linkage between the valve and the cam. Lost motion is the term applied to a class of technical solutions for modifying the valve motion proscribed by a cam profile with a variable length mechanical, hydraulic, or other linkage assembly. In a lost motion system, a cam lobe may provide the "maximum" lift and dwell motion needed over a full range of engine operating conditions. A variable length system may then be included in the valve train linkage, intermediate of the valve to be opened and the cam providing the maximum motion, to selectively subtract or lose part or all of the lift provided by the cam. Such a lost motion system also may be combined with "added motion" components to also extend the duration of valve lift beyond that provided by the cam.

A variable length system (or lost motion system) may, when expanded fully, transmit all of the cam motion to the valve, and when contracted fully, transmit none or a minimum amount of the cam motion to the valve. An example of one lost motion system and method is provided in Hu, U.S. Pat. Nos. 5,537,976 and 5,680,841, which are assigned to the same assignee as the present application and which are incorporated herein by reference.

The aforementioned '841 patent contemplates the use of a high speed trigger valve to control the release of hydraulic fluid from the lost motion system. High speed lost motion systems in particular, may be needed to provide Variable Valve Actuation (VVA). True variable valve actuation is contemplated as being sufficiently fast as to allow the lost motion system to assume more than one length within the duration of a single cam lobe motion, or at least during one cycle of the engine. By using a high speed mechanism to vary the length of the lost motion system, sufficiently precise control may be attained over valve actuation to enable more optimal valve actuation over a range of engine operating conditions. While many devices have been suggested for realizing various degrees of flexibility in valve timing and lift, lost motion hydraulic variable valve actuation is becoming recognized for superior potential in achieving the best mix of flexibility, low power consumption, and reliability.

Engine benefits from lost motion VVA systems can be achieved by creating complex cam profiles with extra lobes or bumps to provide auxiliary valve lifts in addition to the conventional main intake and exhaust events. Many unique modes of engine valve actuation may be produced by a VVA system that includes multi-lobed cams. For example, an intake cam profile may include an additional lobe for EGR prior to the main intake lobe, and/or an exhaust cam profile may include an additional lobe for EGR after the main exhaust lobe. Other auxiliary lobes for cylinder charging, and/or compression release may also be included on the cams. The lost motion VVA system may be used to selectively cancel or activate any or all combinations of valve lifts possible from the assortment of lobes provided on the intake and exhaust cams. As a result, significant improvements may be made to both positive power and engine braking operation of the engine.

The foregoing benefits are not necessarily limited to exhaust and intake valves. It is also contemplated that lost motion may be applied to an auxiliary engine valve that is dedicated to some purpose other than intake or exhaust, such as for example engine braking or EGR. By providing an auxiliary engine valve cam with all of the possible actuations that may be desired and a lost motion VVA system, the actuation of the auxiliary valve may be varied for optimization at different engine speeds and conditions. Lost motion systems therefore, may be particularly useful in engines requiring variable valve actuation for positive power, engine braking valve events (such as, for example, compression release braking), and exhaust gas recirculation valve events.

Each of the foregoing types of valve events (main intake, main exhaust, engine braking, and exhaust gas recirculation) occur as a result of an engine valve being pushed into an engine cylinder to allow the flow of gases to and from the cylinder. Each event inherently has a starting (opening) time and an ending (closing) time, which collectively define the duration of the event. The starting and ending times may be marked relative to the position of the engine (usually the crankshaft position) at the occurrence of each. These valve events also inherently include a point at which the engine valve reaches its maximum extension into the engine cylinder, which is commonly referred to as the valve lift. Thus, each valve event can be defined, at least at a basic level, by its starting and ending time, and the valve lift.

If the lost motion system connecting the engine cam to the engine valve has a fixed length each time a particular lobe acts on the system, then the starting and ending times and the lift for each event marked by that lobe will be fixed. Furthermore, a lost motion system that has a fixed length over the duration of the entire cam revolution will produce a valve event in response to each lobe on the cam, assuming that the system does not incorporate a lash space between the lost motion system and the engine valve. If the lost motion system does not have a fixed length, then the optimal starting time, ending time, and lift of an engine valve will also not be "fixed," and may selectively varied for different engine operating modes and conditions (e.g., different engine load, fueling, cylinder cut-out, etc.), for different engine speeds, and for different environmental conditions. Accordingly, it is desirable to have a lost motion system that is capable of attaining variable lengths over the course of an engine cycle.

One advantage of various embodiments of the present invention is that they may be used to vary the intake and exhaust valve timing and/or lift to provide optimal power and fuel efficiency, if so desired, and so this in such a way that one master piston is operable to drive two slave pistons. The use of a lost motion VVA system allows valve timing and/or lift to be varied in response to changing engine conditions, load and speed. These variations may be made in response to real-time sensing of engine conditions and/or pre-programmed instructions.

It is also desirable to reduce NOx and/or other polluting emissions from the exhaust of internal combustion engines, and diesel engines in particular. One advantage of various embodiments of the present invention is that they may be used to reduce NOx and other polluting emissions by carrying out internal exhaust gas recirculation or trapping residual exhaust gas using variable valve timing and auxiliary lifts of intake, exhaust, and/or auxiliary valves. By allowing exhaust gas to dilute the incoming fresh air charge from the intake manifold, lower peak combustion temperatures may be achieved without large increases in fuel consumption, which may result in less formation of pollution and more complete burning of hydrocarbons.

Also of great interest for diesel engines is the capability of the engine to have an engine braking mode. It is another advantage of various embodiments of the present invention that they may be used to optimize engine braking across an engine speed range, as well as modulate engine braking responsive to driver demand.

In some lost motion hydraulic valve actuation systems, separate master piston-slave piston assemblies may used for opening more than one engine valve at a time. That is, for example, a single master piston assembly is used in conjunction with a single, slave piston assembly. However, for many engine designs, there is simply not enough engine space to accommodate separate master piston-slave piston assemblies.

Accordingly, there is a need for a hydraulic valve actuation system that can reduce the amount of engine space used to house the valve actuation system, as well as the amount of hardware needed. An advantage of some, but not necessarily all embodiments of the present invention may be to reduce the amount of space and hardware required. Additional advantages of the invention are set forth, in part, in the description that follows and, in part, will be apparent to one of ordinary skill in the art from the description and/or from the practice of the invention.

SUMMARY OF THE INVENTION

Responsive to the foregoing challenges, Applicant has developed an innovative engine valve actuation system for internal combustion engine valves comprising: a housing; a first slave piston slidably disposed in a first slave piston bore in the housing; a second slave piston slidably disposed in a second slave piston bore in the housing; a dual diameter master piston slidably disposed in a master piston bore in the housing; and a hydraulic circuit connecting the first and second slave piston bores with the master piston bore.

Applicants have also developed an innovative valve actuation system for internal combustion engine valves comprising: a housing; a plurality of slave pistons slidably disposed in a corresponding plurality of slave piston bores in the housing and adapted to actuate one or more engine valves; a dual diameter master piston slidably disposed in a master piston bore in the housing; a hydraulic circuit connecting the plurality of slave piston bores with multiple portions of the master piston bore; a means for imparting motion to the dual diameter master piston; a hydraulic fluid supply connected to the hydraulic circuit; and multiple hydraulic control valves disposed in the hydraulic circuit between the plurality of slave piston bores and the hydraulic fluid supply.

It is to be understood that both the foregoing general description and the following detailed description are exemplary and explanatory only, and are not restrictive of the invention as claimed. The accompanying drawings, which are incorporated herein by reference, and which constitute a part of this specification, illustrate certain embodiments of the invention and, together with the detailed description, serve to explain the principles of the present invention.

BRIEF DESCRIPTION OF THE DRAWINGS

In order to assist the understanding of this invention, reference will now be made to the appended drawings, in which like reference characters refer to like elements. The drawings are exemplary only, and should not be construed as limiting the invention.

DETAILED DESCRIPTION OF THE PRESENT INVENTION

Figure 1:
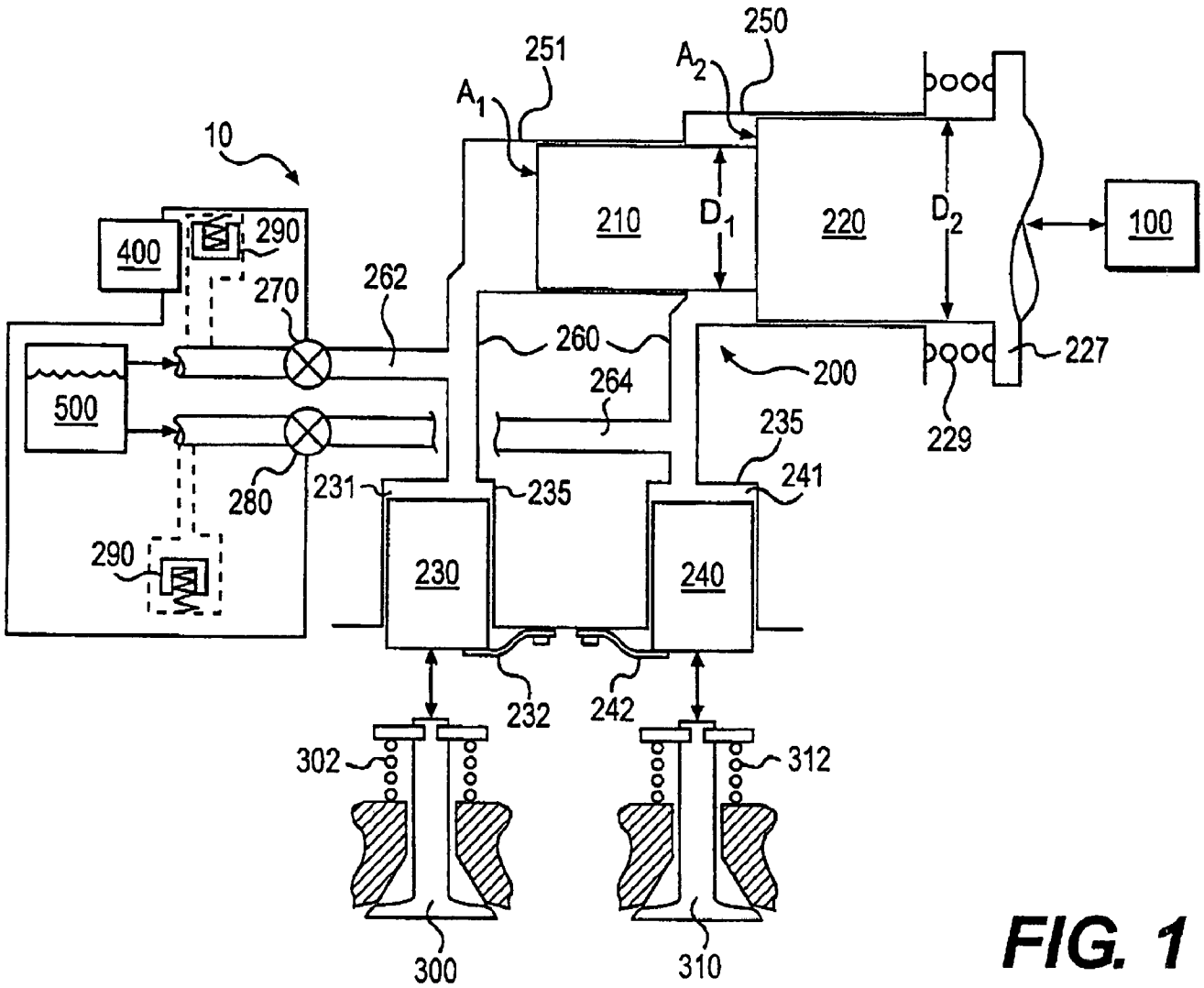
FIG. 1 is a schematic diagram of a partial valve actuation system including a dual area mater piston and two, separate slave pistons according to an exemplary embodiment of the present invention.

As embodied herein, the present invention includes both systems for and methods of controlling the actuation of engine valves. Reference will now be made in detail to a first embodiment of the present invention, an example of which is illustrated in FIG. 1 as valve actuation system 10. The valve actuation system 10 may include a means for imparting motion 100 operatively connected to a lost motion system 200, which in turn is operatively connected to one or more engine valves 300 and 310. An electronic valve control unit (VCU) 400 may control the supply and release of hydraulic fluid to and from the lost motion system 200.

The motion imparting means 100 may include any combination of cam(s), push tube(s), rocker arm(s) or other valve train element(s) that provide an input motion to the lost motion system 200 and more specifically input motion to the master piston assembly 210/220. Examples of means for imparting motion that may be used in conjunction with the present invention are described in U.S. patent Publication No. 2006-0005796, which is assigned to the same assignee as the present application and which is incorporated herein by reference.

The lost motion system 200 may comprise any structure that at least in part hydraulically actuates the engine valves 300 and 310. For example, the lost motion system 200 may comprise a mechanical linkage, a hydraulic circuit, a hydromechanical linkage, an electromechanical linkage, and/or any other linkage adapted to attain more than one operative length and actuate an engine valve. In the embodiment shown in FIG. 1, the lost motion system 200 may include a master piston assembly 210/220, two or more slave pistons 230 and 240, and a hydraulic circuit 260 connecting the master piston assembly, the slave pistons, and a hydraulic fluid supply 500.

The master piston assembly 210/220 may be comprised of two master piston elements, referred to as an inner master piston 210 and an outer master piston 220, which are each slidably disposed in an inner bore 251 and an outer bore 250 provided in a lost motion system housing 235, respectively. The inner master piston 210 and the outer master piston 220 may be formed of an integral piece of material, or be separate elements that are connected together through any of a number of potential fastening means. The inner master piston 210 may be cylindrically shaped and have a diameter of $D_1$ with a cross-sectional area $A_1$, and the outer master piston 220 may be cylindrically shaped and have a diameter of $D_2$ with an exposed cross-sectional area $A_2$, where $D_1$ is not equal to $D_2$. Thus the master piston assembly may be referred to as a "dual diameter" master piston, meaning that the master piston has two diameters of different lengths. The area of the exposed cross-sectional area $A_2$ may be determined by the formula $A_2=\Pi(D_2/2)^2-\Pi(D_1/2)^2$ where $\Pi(D_1/2)^2=A_1$. In the embodiment shown, $A_1$ is substantially equal to $A_2$, however it is appreciated that in alternative embodiments, $A_1$ may be greater than $A_2$, or $A_1$ may be less than $A_2$. The master piston assembly 210/220 may be biased towards and into the means for imparting motion 100 by one or more springs or other biasing means 229. If a spring 229 is used to bias the master piston assembly 210/220, it may act against a flange 227 provided on the master piston assembly.

The inner master piston 210 may form a sliding hydraulic seal with the inner bore 251 and the outer master piston 220 may form a sliding hydraulic seal with the outer bore 250 such that the hydraulic fluid space between the end of the inner master piston 210 and the end of the inner bore 251 is sealed from the hydraulic fluid space between the end of the outer master piston 220 and the end of the outer bore 250. The hydraulic fluid space between the inner master piston 210 and the end of the inner bore 251 may hydraulically communicate with the first slave piston 230 and the first hydraulic valve 270 via the first fluid sub-circuit 262. The hydraulic fluid space between the outer master piston 220 and the end of the outer bore 250 may hydraulically communicate with the second slave piston 240 and the second hydraulic valve 280 via the second fluid sub-circuit 264. The first and second hydraulic valves 270 and 280, which may preferably but not necessarily be solenoid controlled high-speed trigger valves, may be disposed in the hydraulic circuits 262 and 264 between the hydraulic fluid supply 500 and each of the slave pistons 230 and 240, respectively. The hydraulic fluid supply 500 may preferably be a low pressure oil supply source.

The first and second slave piston assemblies 230 and 240 may be slidably disposed in first and second slave piston bores, 231 and 241, respectively, that are provided in a housing 235. The first and second slave pistons 230 and 240 may be capable of sliding back and forth in their respective bores while maintaining a hydraulic seal with the housing 235. The first and second slave piston assemblies 230 and 240 may make contact the engine valves 300 and 310 directly (as shown) or may act on multiple valves through valve bridges (not shown). It is appreciated that the valve bridge could comprise, for example, a floating bridge, or other guide structures known in the art. The slave pistons 230 and 240 may be maintained in their respective slave piston bores 231 and 241 by retaining springs 232 and 242.

The VCU control means 400 may comprise any electronic, mechanical or hydraulic device for controlling the supply of hydraulic fluid to the lost motion system 200 and/or the release of hydraulic fluid from the lost motion system. The control means 400 may include a microprocessor, linked to an appropriate vehicle component(s) adapted to selectively supply the lost motion system 200 with hydraulic fluid and to selectively permit the release of hydraulic fluid from the lost motion system. The control means 400 may include, without limitation, an engine speed sensing means, a clutch position sensing means, a fuel position sensing means, and/or a vehicle speed sensing means. Under prescribed conditions, the control means 400 may produce a signal and transmit the signal to the hydraulic valves 270 and/or 280 to provide for engine valve actuation using the lost motion system 200. For example, when the control means 400 determines that an auxiliary engine operation mode, such as engine braking, is desired, based on any operational condition, such as, idle fuel, engaged clutch, and/or an engine RPM greater than a certain speed, the control means 400 may produce and transmit one or more signals to the hydraulic valves 270 and 280 to cause the hydraulic valves to selectively open and close to provide engine braking using the lost motion system.

With continued reference to FIG. 1, the lost motion system 200 may operate as follows. The system 200 may be initially charged with hydraulic fluid by selectively opening the hydraulic valves 270 and 280 to allow hydraulic fluid to fill the hydraulic circuit 260. Maintaining the hydraulic valves 270 and 280 in an open condition may result in the motion of the master piston assembly 210/220 being absorbed by the fluid supply 500 and/or the accumulators 290 and/or in the fluid that is drawn into the hydraulic circuit 260 being dumped out of the lost motion system. To initiate an auxiliary valve actuation event using the lost motion system, such as an engine braking event, the controller 400 may selectively close the hydraulic valves 270 and 280, to create a hydraulic lock between the master piston assembly 210/220 and the slave pistons 270 and 280. It is appreciated by controlling the hydraulic valves 270 and 280 individually, the hydraulic lock may be provided between only one or the other of the slave pistons 270 and 280 and the master piston assembly 210/220. By selectively opening and closing each of the hydraulic valves 270 and 280 under the control of the controller 400, the lost motion system may selectively allow hydraulic fluid to escape from and be supplied to the hydraulic sub-circuits 262 and 264 and thereby selectively lose the motion available to be imparted from the master piston assembly 210/220 to the slave pistons. As a result, the lost motion system may use a single master piston assembly 210/220 to selectively provide auxiliary valve actuation, such as late valve opening, early valve closing and centered lift valve actuation to each of the engine valves 300 and 310, individually.

The lost motion system 200 may be switched between a mode of losing motion and not losing motion input from the means for imparting motion 100 in response to a signal or input from the control means 400. By selectively switching between a mode of losing motion and not losing motion at high speed, the lost motion system 200 may operate as a variable valve actuation (VVA) system that may transfer some, all, or none of the motion input from the motion imparting means 100 to the engine valves 300 and 310, and in some embodiments, extend the duration of the motion input from another valve actuation means, such as a rocker arm. The motion transferred to the engine valves 300 and 310 and the loss of such motion may be used to produce various engine valve events, such as, but not limited to, main intake, main exhaust, compression release braking, bleeder braking, exhaust gas recirculation, brake gas recirculation, late valve opening, early valve closing, centered lift, etc.

In the aforementioned embodiment of the present invention, the hydraulic sub-circuits 262 and/or 264 may further include accumulator(s) 290 to assist with hydraulic sub-circuit purge and refill functions.

Figure 2:
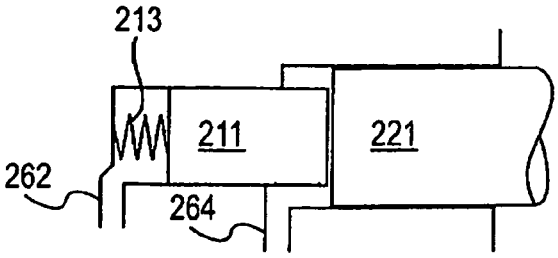
FIG. 2 is a schematic diagram of a dual area master piston having a spring to bias two pieces of the piston together according to an exemplary embodiment of the present invention.

With reference to FIG. 2, in an alternative embodiment of the present invention, the master piston assembly 210/220 may be split into two discrete elements 211 and 221. Further, a spring 213 may be used to bias the two elements 211 and 212 together and towards the means for imparting motion (not shown). In this manner, concentricity requirements for the two master pistons may be reduced or eliminated. Further, the predetermined areas $A_1$ and $A_2$ of the master pistons 211 and 221 may be such that the hydraulic pressure acting on the first master piston 211 may be greater than that acting on the second master piston 221 so that the two master pistons do not separate during operation.

Figure 3:
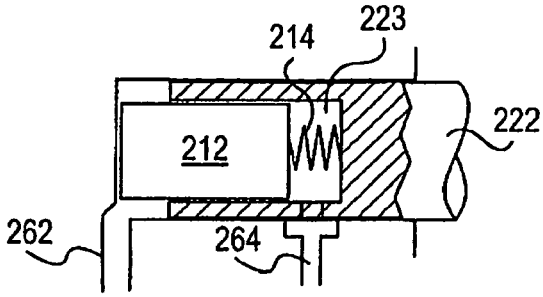
FIG. 3 is a schematic diagram of a dual area master piston wherein one piston is contained within housing of the other piston according to an exemplary embodiment of the present invention.

Another alternative embodiment of the master piston assembly is shown in FIG. 3 in which the master piston assembly is comprised of two discrete elements 212 and 222 with a spring 214 disposed between them and biasing the first master piston 212 and the second master piston 222 apart. In this embodiment, the first master piston 212 may be slidably disposed in a bore 223 provided within the second master piston 222. This arrangement may save space in the engine by making the lost motion system more compact.

Figure 4:
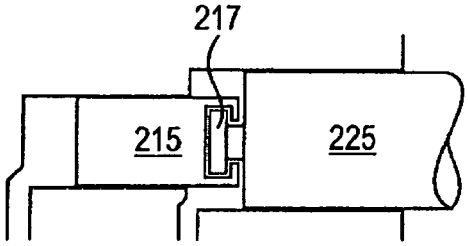
FIG. 4 is a schematic diagram of a dual area master piston having a button and T-slot arrangement according to an exemplary embodiment of the present invention.
Figure 5:
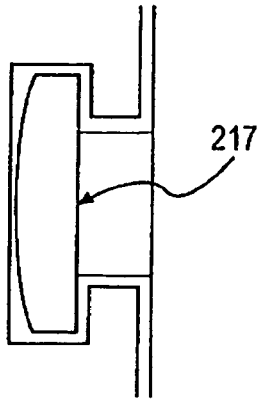
FIG. 5 is a schematic diagram of the button and T-slot arrangement according to FIG. 4.

Yet another alternative embodiment of a the master piston assembly is shown in FIGS. 4 and 5. In this embodiment, the master piston assembly may include two discrete elements 215 and 225. In this embodiment a button and T-slot assembly 217 may be used to connect the first and second master pistons 215 and 225 together. The button and T-slot arrangement 217 may permit sufficient radial motion between the two master pistons 215 and 225 to accommodate normal amounts of eccentricity between the bores in which the two master pistons are disposed while preventing the two master pistons from separating. FIG. 5 is an enlargement of the button and T-slot assembly 217 shown in FIG. 4.

It will be apparent to those skilled in the art that variations and modifications of the present invention can be made without departing from the scope or spirit of the invention. The components and arrangement of the hydraulic valve actuation system and the hydraulic control valves used therewith are presented as examples only. It is contemplated that modifications and variations of the valve actuation system and control valves may be used in alternative embodiments of the invention without departing from the scope of the appended claims. For example the shapes and sizes of the master pistons and slave pistons may be varied without departing from the intended scope of the present invention. Further, a single hydraulic valve may be used to control the supply of hydraulic fluid to multiple slave pistons without departing from the intended scope of the present invention. Still further, it is contemplated that the lost motion system described may be combined with other valve actuation systems, such as traditional mechanical cam operated valve actuation systems to provide combined mechanical and hydraulic valve actuation. Still further yet, it is contemplated that the principles discussed herein for making and using a dual area master piston may be used to provide a system with a master piston having more than two areas to drive more than two slave pistons or to provide multiple master pistons for a single slave piston. Thus, it is intended that the scope of the present claims cover all such modifications and variations of the invention.

What is claimed is:

1. A valve actuation system for internal combustion engine valves comprising:

a housing;

a first slave piston slidably disposed in a first slave piston bore in the housing;

a second slave piston slidably disposed in a second slave piston bore in the housing;

a dual diameter master piston assembly slidably disposed in a master piston bore in the housing, said master piston bore having an inner bore and an outer bore, and said dual diameter master piston assembly having an inner master piston slidably disposed in the inner bore and an outer master piston slidably disposed in the outer bore; and a hydraulic circuit connecting the first slave piston bore with the inner bore and connecting the second slave piston bore with the outer bore.

2. The valve actuation system according to claim 1 further comprising means for selectively supplying hydraulic fluid to the hydraulic circuit.

3. The valve actuation system according to claim 2, wherein the means for selectively supplying hydraulic fluid comprises:

a hydraulic fluid supply connected to the hydraulic circuit;

a hydraulic valve disposed in the hydraulic circuit between the hydraulic fluid supply and at least the first slave piston bore; and a means for controlling the hydraulic valve.

4. The valve actuation system according to claim 3, wherein the hydraulic valve comprises a high-speed trigger valve.

5. The valve actuation system according to claim 1, wherein the dual diameter master piston assembly is comprised of at least two discrete master pistons.

6. The valve actuation system according to claim 5, wherein the at least two discrete master pistons are biased relative to each other by a spring.

7. The valve actuation system according to claim 5, wherein the at least two discrete master pistons are connected to each other.

8. The valve actuation system according to claim 5, wherein the at least two discrete master pistons are connected by a button and T-slot assembly.

9. The valve actuation system according to claim 1, wherein the dual diameter master piston assembly is disposed such that its axis is substantially perpendicular to axis of the slave pistons.

10. The valve actuation system according to claim 1, wherein:

the inner master piston has a first exposed area to a hydraulic fluid space in the inner bore; and the outer master piston has a second exposed area to a hydraulic fluid space in the outer bore, and wherein the first exposed area and the second exposed area are substantially equal.

11. The valve actuation system according to claim 1, wherein:

the inner master piston has a first exposed area to a hydraulic fluid space in the inner bore; and the outer master piston has a second exposed area to a hydraulic fluid space in the outer bore, and wherein the magnitude of first exposed area is different from the magnitude of the second exposed area.

12. A valve actuation system for internal combustion engine valves comprising:

a housing;

a first slave piston slidably disposed in a first slave piston bore in the housing;

a second slave piston slidably disposed in a second slave piston bore in the housing;

a dual diameter master piston assembly disposed in a master piston bore in the housing, said dual diameter master piston assembly having an outer master piston slidably disposed in the master piston bore and an inner master piston slidably disposed in a bore provided in the outer master piston; and a hydraulic circuit connecting the first slave piston bore with the master piston bore and connecting the second slave piston bore with the bore provided jn the outer master piston.

13. A valve actuation system for internal combustion engine valves comprising:

a housing;

a plurality of slave pistons slidably disposed in a corresponding plurality of slave piston bores in the housing and adapted to actuate one or more engine valves;

a dual diameter master piston slidably disposed in a master piston bore in the housing;

a hydraulic circuit connecting the plurality of slave piston bores with multiple portions of the master piston bore;

a means for imparting motion to the dual diameter master piston;

a hydraulic fluid supply connected to the hydraulic circuit; and multiple hydraulic control valves disposed in the hydraulic circuit between the plurality of slave piston bores and the hydraulic fluid supply.

14. The valve actuation system according to claim 13 wherein the dual diameter master piston comprises two master pistons of different sizes integrally formed together.

15. The valve actuation system according to claim 13 wherein the dual diameter master piston comprises two master pistons of different sizes connected together.

16. The valve actuation system according to claim 13 wherein the dual diameter master piston comprises two master pistons of different sizes biased together.

17. The valve actuation system according to claim 13 wherein the dual diameter master piston comprises a first master piston provided with an internal bore and a second master piston slidably disposed in the internal bore.

* * * * *